United States Patent [19]

Manor

[11] 4,120,548

[45] Oct. 17, 1978

[54] DISPLACEABLE GARBAGE BIN HOLDER

[76] Inventor: Nathan Manor, 69 Zahal St., Tel Aviv, Israel

[21] Appl. No.: 751,944

[22] Filed: Dec. 17, 1976

[30] Foreign Application Priority Data

Sep. 16, 1976 [IL] Israel ..... 50492

[51] Int. Cl.[2] ..... A47B 51/00

[52] U.S. Cl. ..... 312/249; 312/325; 312/329; 312/270; 248/147

[58] Field of Search ..... 312/249–325, 312/138 A, 270–272, 322, 329, 310; 248/95, 99, 101, 102, 147

[56] References Cited

U.S. PATENT DOCUMENTS

| | | | |
|---|---|---|---|
| 470,037 | 3/1892 | Cary | 312/325 |
| 806,277 | 12/1905 | McKee | 312/270 X |
| 1,943,577 | 1/1934 | Auerbach | 312/322 X |
| 3,081,138 | 3/1963 | Stebbins | 312/325 |
| 3,137,469 | 6/1964 | Stanley | 248/147 |
| 3,183,050 | 5/1965 | Hudson | 312/270 |
| 3,458,243 | 7/1969 | Gefroh | 312/329 |
| 3,558,088 | 1/1971 | Sherley | 248/147 |
| 3,575,483 | 4/1971 | Church | 312/325 |

FOREIGN PATENT DOCUMENTS

| | | | |
|---|---|---|---|
| 1,005,025 | 7/1952 | France | 312/325 |

*Primary Examiner*—Mervin Stein
*Assistant Examiner*—Victor N. Sakran
*Attorney, Agent, or Firm*—Ostrolenk, Faber, Gerb & Soffen

[57] ABSTRACT

A domestic garbage bin is mounted on a holder pivotally mounted to be swung into and out a compartment. The holder comprises a manipulatable four-bar-linkage system by which the bin is adapted to be raised to a higher level position and maintained self-supported in such position. The elements of system are so designed and assembled that the same unit may readily be employed for right-hand and left-hand mountings.

8 Claims, 12 Drawing Figures

DISPLACEABLE GARBAGE BIN HOLDER

BACKGROUND OF THE INVENTION

The present invention relates to garbage bins and more particularly to such bins which serve domestic purposes and which may be kept in a cupboard or similar compartment and removably connected to the inside of the door thereof, so that when the door is opened the garbage bin is swung out and garbage can be deposited therein.

It is known to suspend the bin from and alongside of a parrallelogram four-bar-linkage, the rear one of the bars extending vertically and in parallel with the inner side of the door of the respective cupboard, and being adapted to be affixed to a doorpost or like stationary member, the opposite, front bar of the four-bar-linkage being provided with means for removably affixing thereto the bin. Some kind of stop means had to be provided in order to arrest the system in the elevated position to prevent it from collapsing back under the weight of the loaded bin.

The provision of such stop means had caused inconvenience in the use of the device and increased the manufacturing costs thereof.

In the usual cases where the bin assembly is to be installed in kitchen cupboards — the conventional arrangement did not provide for the interchangeability between right and left-hand mounting requisits; hence, two different types of holder units had to be produced and sold separately to the public, and/or always readily available in inventory.

BRIEF SUMMARY OF THE INVENTION

It is the general object of the invention to overcome the disadvantages of the known displaceable garbage bin holders. According to the present invention, there is provided a displaceable garbage-bin holder having a support frame swingable about a vertical axis provided at a rear side of the frame and a linkage system for the vertical displacement of the bin. The linkage system comprises first, second and third link-bars. The first link-bar is pivotably mounted at one end to the front end of the frame by a first journal, the second link-bar is pivotably mounted at one end to the front end of the frame by a second journal located below the first journal and the third link-bar is pivotably mounted to the opposite ends of the first and second link-bars by third and fourth journals, respectively. Means are provided for suspending a garbage-bin on the third link-bar and a handle for pivoting the linkage system about the first and second journals so that the third journal is displaced from a lower position to an elevated position beyond the upper dead-center of the linkage system defined by a line passing through the first and second journals, for stably supporting the linkage system in an elevated position.

In one preferred embodiment of the invention, the distance between the said first and second journals is smaller than the distance between the said third and fourth journals.

In yet another embodiment, the said distance between the said first and second journals is equal to the distance between the said third and fourth journals, and the distance between the said first and third journals is equal to the distance between the said second and fourth journals, the first and second journals being aligned along a non-vertical line.

For attaining the above mentioned interchangeability properties, the said frame would preferably comprise an upper frame-bar and a lower frame-bar, said first and second link-bars being installed at one side of both said upper and lower fram-bars and said third link-bar extending across opposite sides of the upper and lower frame-bars, respectively.

BRIEF DESCRIPTION OF THE DRAWINGS

These and further features of the invention would become more fully understood in the light of the following description of two preferred embodiments thereof, given by way of example only, with reference to the attached drawings, wherein -

FIG. 1 shows a typical kitchen cupboard or compartment, having a door 2 hanging on hinges 4 and side walls 6 and 8. A garbage bin GB suspended from a holder 10 is stored within the cupboard and is adapted to be swung outwardly when the door 2 is opened. The bin GB comprises a cover GC, hinged by a spring-loaded hinge H for the self-opening of the cover when the bin is brought to the outer position, where it is no longer held by the extension 14 of the bracket 12. It will be noted that the bracket 12 is fastened to the door frame (rather than to the door proper) in order to relieve the door hinges of the weight of the bin, and also to provide automatic closing of the lid GC when the door 2 is closed. A plastic shoe-like member 16 may be provided for reducing friction during the slidable movement over the top surface of the cover GC; moreover, the member 16 would preferably be adapted to fit the extension 14 in two opposite positions (as shown in dashed lines) FIG. 2 for the purpose of converting the mounting of the holder from right-hand to left-hand position, as will be described below in more detail.

Figure 1:
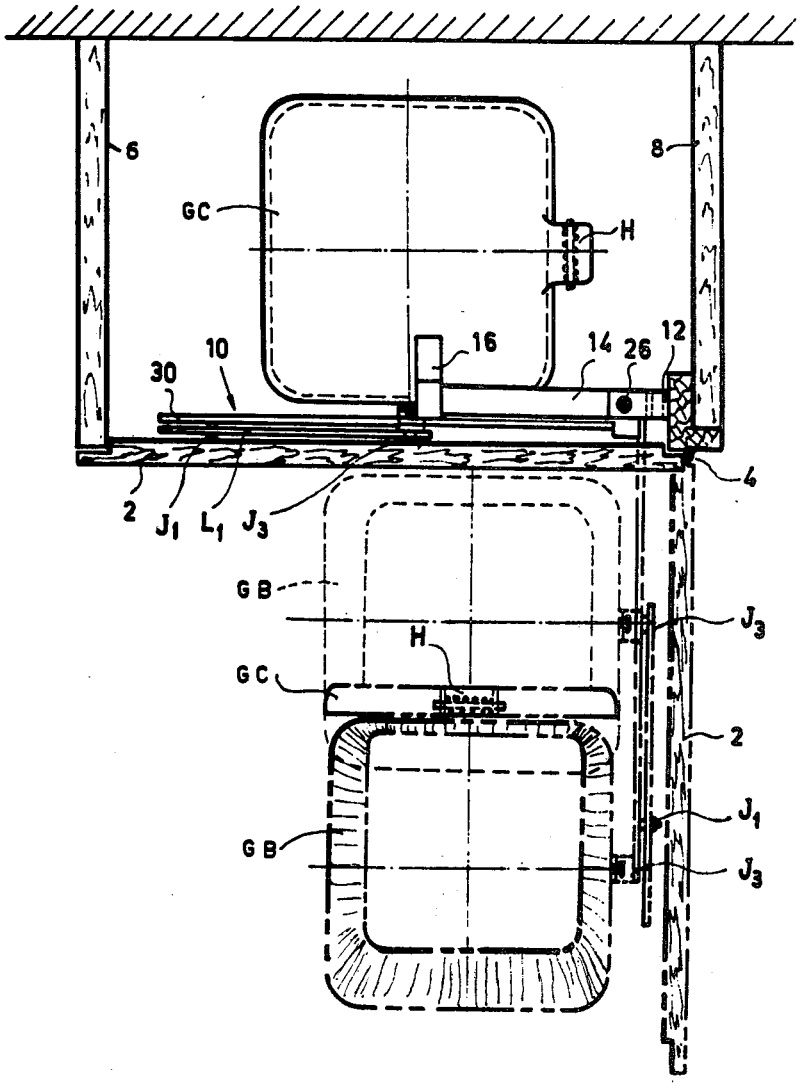
FIG. 1 shows the garbage bin compartment in plan view with the bin in the inside and the outside positions.

The holder 10 (FIG. 2) comprises a swingable support frame generally indicated 18 having an upright bar 20 with two angle-pieces 22, 24 through which the pivot pins 26, 28 extend, thus providing the vertical axis about which the frame 18 is adapted to rotate.

It should be pointed out in this connection that it may be advisable not to place the pin 26 in exact vertical alignment with respect to the pin 28, in order to incline the vertical pivot axis and thereby to unbalance the compartment door in the direction tending to move same by its own weight to the open position.

The frame 18 is completed by a U-shaped member having an upper leg 30, a lower leg 32 and a connection 34 therebetween. The free ends of the legs 30, 32 are rivetted or otherwise fastened at 36, 38 to the upright 20, as shown (see FIGS. 7 and 8). The frame may of course be constructed of discrete components (bars, rails or the like constructional elements), made of metal or plastics material.

There is provided a linkage system which includes a first link-bar $L_1$ extended by the handle portion 40 and journaled at the point $J_1$ to the upper frame-bar 30, a second link-bar $L_2$ journaled at $J_2$ to the lower frame-bar 32, and a third link-bar $L_3$ journaled at $J_3$ to the free end of the link-bar $L_1$ and at $J_4$ to the free end of the link-bar $L_2$.

Figure 3:
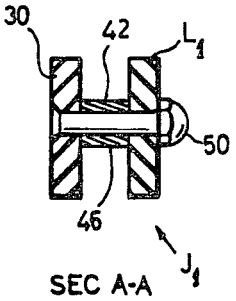
FIG. 3 is the cross-section A—A of FIG. 2.
Figure 4:
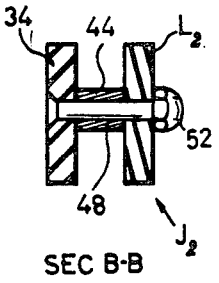
FIG. 4 is the cross-section B—B of FIG. 2.

As best seen in FIGS. 3 and 4, the journals $J_1$ and $J_2$ are identical, each comprising a spacer washer 42, 44 for establishing a fixed distance between the respective bars 30, $L_1$ and 32, $L_2$ when tightened together by the bolts 46, 48 and cap-nuts 50, 52 — respectively; the function of the spacers and the cap-nuts will be explained further below.

Figure 6:
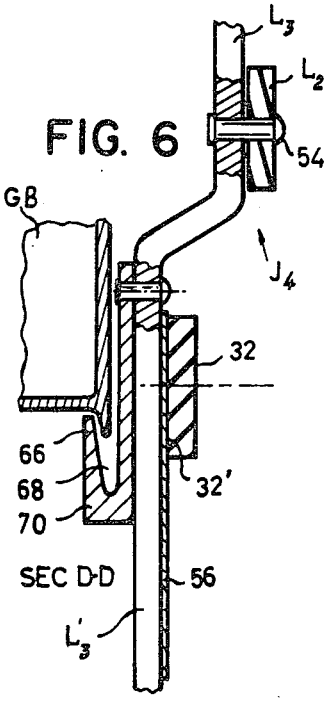
FIG. 6 is the cross-section D—D of FIG. 2.

FIG. 6 shows the lower portion of the third link-bar $L_3$. Just below the journal $J_4$, where link-bar $L_2$ is pivotally connected by the rivet 54 to link-bar $L_3$, the latter is bent-over twice so that the remaining part thereof is off-set, now extending across the opposite surface 32' of the lower frame-bar 32. A friction lining piece 56 is attached to said part for smoothing the sliding of the bar portion $L_{3'}$ along the bar 32, as described below.

Figure 5:
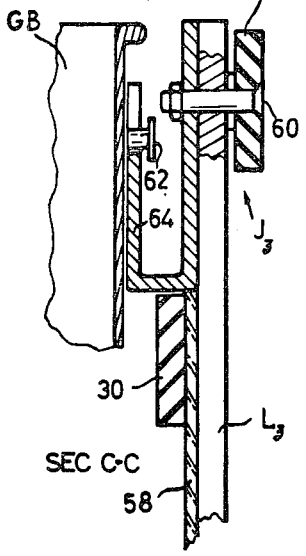
FIG. 5 is the cross-section C—C of FIG. 2.

The upper portion of the link-bar $L_3$ (FIG. 5) is provided as well with lining 58 (placed at the opposite side thereof), below the journal $J_3$ comprised of the bolt 60 pivotally connecting the bars $L_1$ and $L_3$ together.

Figure 1A:
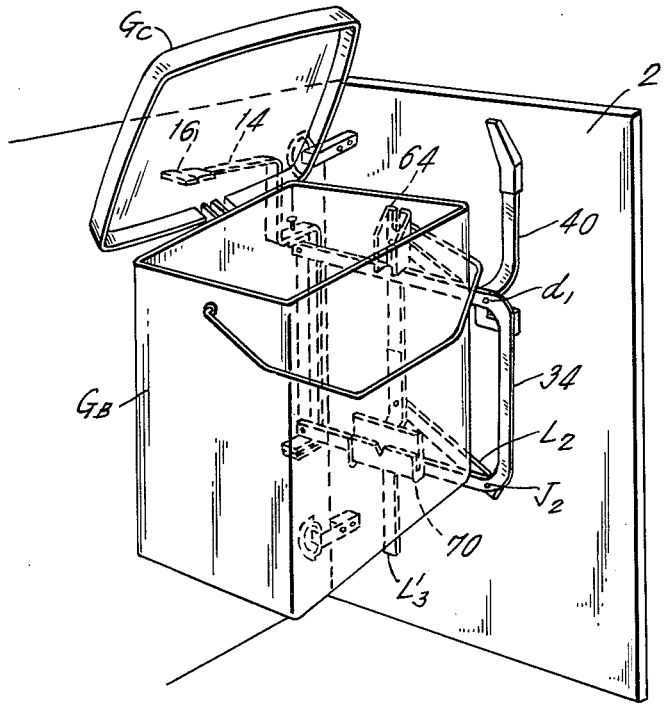
FIGS. 1*a* and 1*b* illustrate the device of FIG. 1, with the holder and bin in their lower and elevated positions, respectively.
Figure 1B:
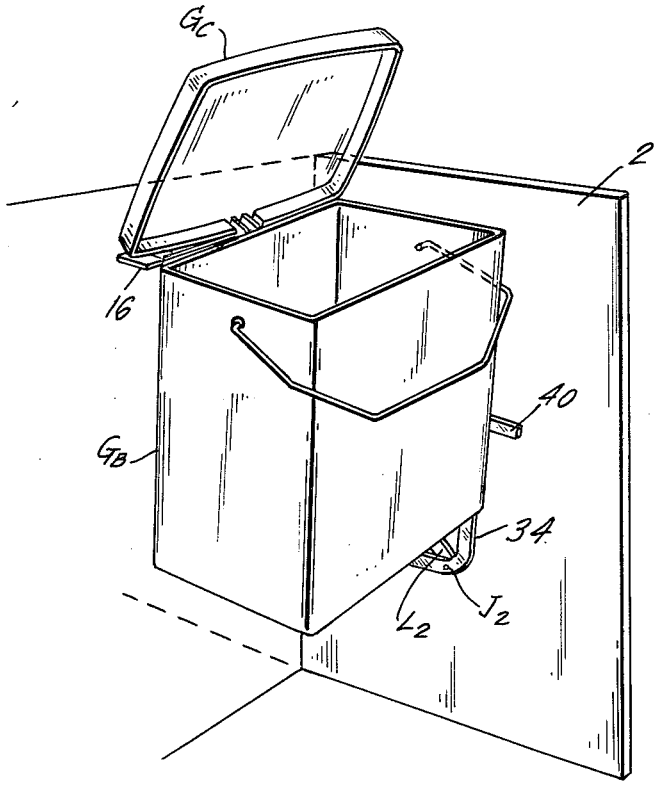

As in the conventional arrangements, the bin GB may be suspended from a slotted hook member 64 by one of its handle pivots (FIG. 1*a*) or, by a mushroom-like pin 62, whereas its bottom rim 66 (FIG. 6) of the bin CB rests inside cavity 68 of a support member 70 fixed to the lower end of link-bar $L_3$.

The operation of the garbage-bin linkage system will now be described with reference to FIG. 2. It must first be noted that — according to the presently discussed embodiment of the invention — the link-bars system does not form a parallelogram four bar linkage; the distance between journals $J_1$ and $J_2$ is somewhat smaller than the distance between journals $J_3$ and $J_4$.

Figure 2:
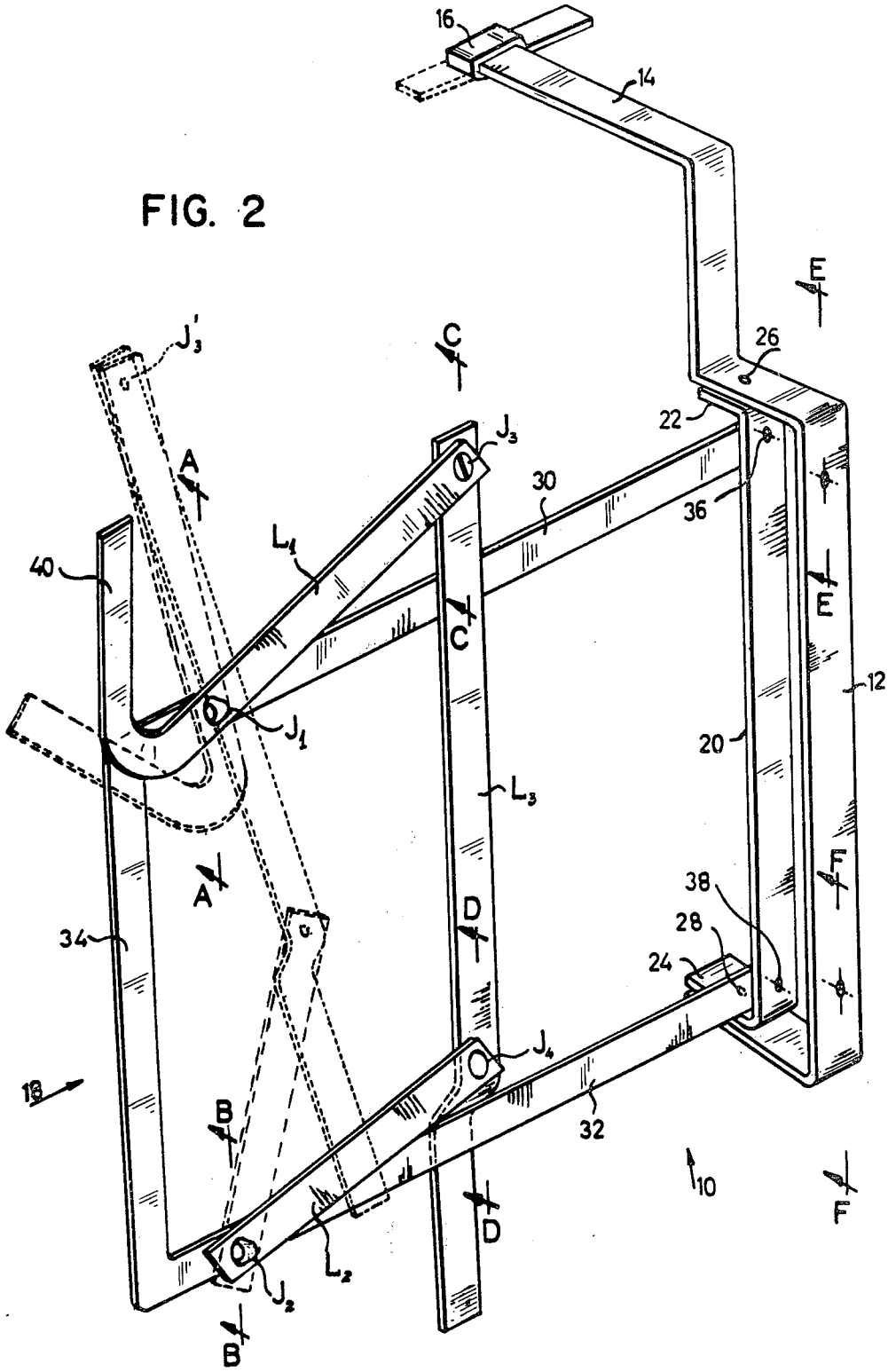
FIG. 2 is an isometric view of the holder's main components, in the normal and in the elevated (in dashed lines) positions.

Consequently, upon the rotation of the link-bar $L_1$ (counter-clockwise to the dashed line position illustrated in FIG. 2) by its extended handle portion 40, until link-bar $L_3$ abuts against spacer 42 (FIG. 3) of journal $J_1$, journal $J_3$ will become located at an elevated point $J_{3'}$ which is slightly forwardly (leftwardly, FIG. 2) of the line passing through journals $J_1$ and $J_2$, before the narrow side surface of the link-bar $L_3$ would abut against the spacer 42 (FIG. 3) of journal $J_1$. In other words, the system will reach and tip-over its upper dead-center determined by the relative positions of journals $J_1$, $J_2$ and $J_3$, with respect to the vertical. Once this condition is satisfied — the linkage system would become self-sustained or stable in its elevated position without any further external catch or stop means whatsoever.

Since link-bar $L_3$ is translated from the initial, substantially vertical position, to an inclined position (shown in dashed lines in FIG. 2), the garbage-bin proper will also assume a corresponding tilted position; this, however, is considered advantageous as it renders the deposition of garbage thereinto even more convenient than if it were moved parallel to itself.

Figure 9:
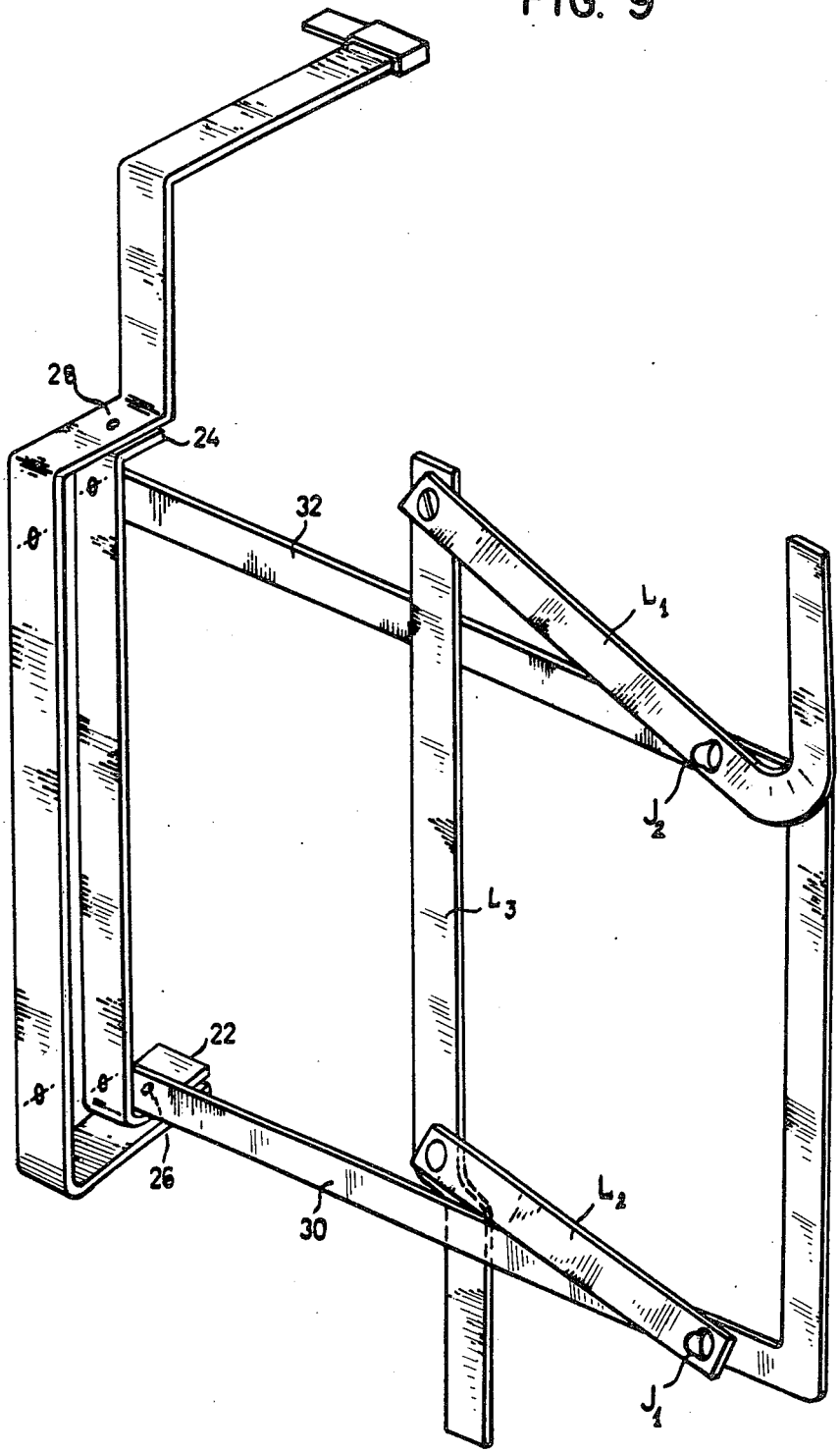
FIG. 9 shows the holder of FIG. 2 assembled as a left-hand unit.

The procedure by which the arrangement heretofore described may be transformed from a right-hand to a left-hand mountable unit will now be illustrated with reference to FIG. 9.

Figure 7:
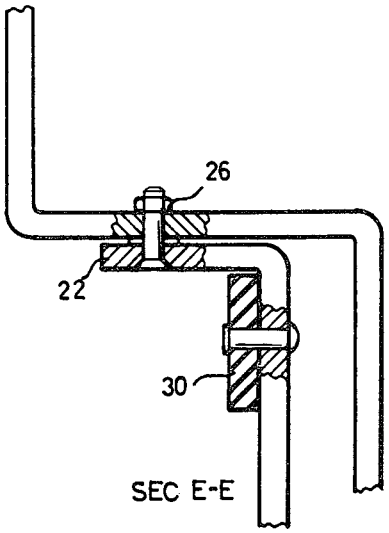
FIG. 7 is the cross-section E—E of FIG. 2.
Figure 8:
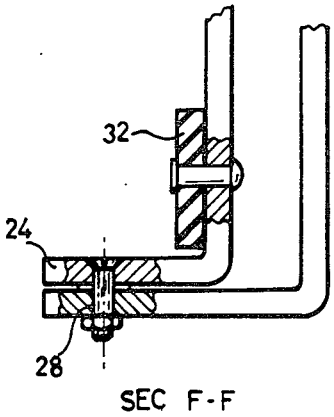
FIG. 8 is the cross-section F—F of FIG. 2.

The first step would be to unfasten the pivot pins 26 and 28 which are therefore conveniently formed by a screw and nut assembly, as shown in FIGS. 7 and 8. Then, the whole frame would be turned upside-down and replaced on the bracket 12 by the screws 28 and 26; the upper pivot 26 and frame-bar 30 become replaced by the lower pivot 28 and frame-bar 32, and vice-versa.

It would be noted that the journals $J_1$ and $J_2$ are symmetrically located on the fram-bars 30 and 32 with respect to the longitudinal (horizontal) axis of the frame. Now, for completing the transposition of the unit it would be required to dismount the linkage system by slackening the cap-nuts 50 and 52, of journals $J_1$, $J_2$, respectively and reassemble the same in the upright position as follows: Link-bar $L_3$ would be rotated about itself by 180°; link-bar $L_2$ would be rotated about journal $J_4$ and re-fastened by the bolt 48 to form journal $J_2$; and link-bar and handle $L_1$ would be likewise rotated but also dismounted, inverted and re-fastened by the bolts 46 and 60, so that the handle portion 40 would reassume its upward directed position.

Lastly, the member 16 would be pulled-out and reassembled at the end of the bar 14 in the direction of the cover GC to assure the firm closing thereof.

It would thus be seen that the off-set bent portion $L_{3'}$ of the link-bar $L_3$ would again be placed inside of the frame, and the cap-nuts 50, 52 would project to the outside where sliding contact with the inside surface of the cupboard door 2 would be established, as known.

The foregoing feature of the invention enabling the device to be conveniently adapted for left-hand or right-hand use, is considered to be of great importance, since it results a substantial saving of production costs, and facilitates the effective marketing of the units in both the assembled and knocked-down forms.

Figure 10:
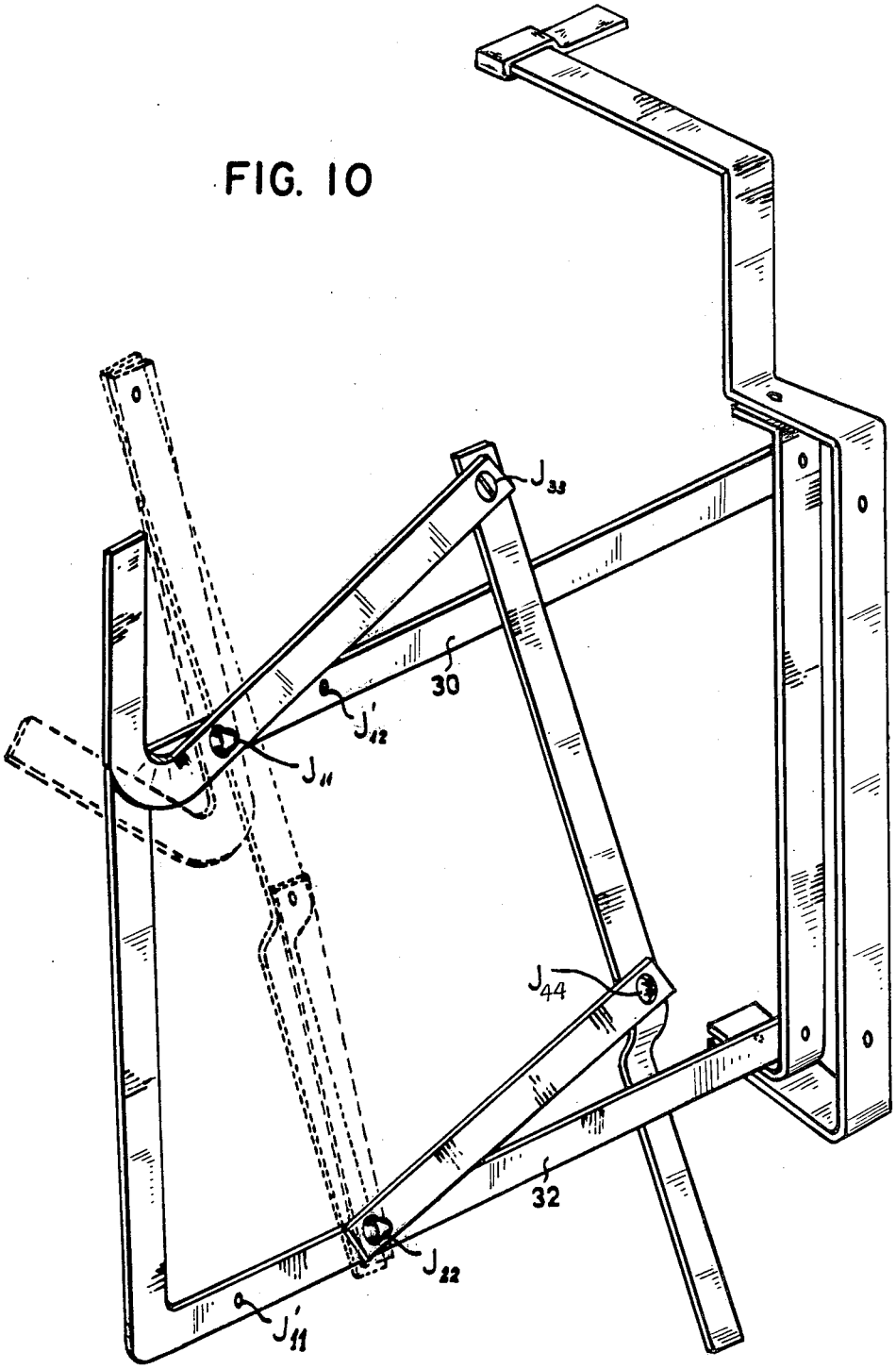
FIG. 10 shows another embodiment of the invention.

The embodiment illustrated in FIG. 10 differs from the former one mainly in that the linkage system employed forms in fact a parallelogram-four-arm-linkage, namely, the distance between journals $J_{11}$ and $J_{22}$ is equal to the distance between journals $J_{33}$ and $J_{44}$, and the distance between journals $J_{11}$ and $J_{33}$ is equal to the distance between journals $J_{22}$ and $J_{44}$.

For the attainment of the off-dead-center self-resting position requirement as above explained, it is necessary to install the linkage system at an angle with respect to the vertical, as shown, the greater the angle, the more stable will the system be in its off-dead-centre position. In all remaining respects this configuration is similar to the former and need not be further explained, except for that two additional symmetrically located bores $J_{22}'$ and $J_{11}'$ must be prepared in the upper frame bar 30 and the lower frame bar 32, respectively. These bores would be used for the transposition from right-hand to left-hand sided units in the manner above described.

It would be readily understood and appreciated by those skilled in the art to which this invention pertains, that the present invention presents a substantial progress over the prior art arrangements, and, furthermore, that many modifications and variations may be applied to the exemplified embodiments herein disclosed without departing from the scope of the invention as defined in the appended claims.

What is claimed is:

1. A displaceable garbage-bin holder having a support frame which is pivotably connected to a bracket means for mounting the holder onto a stationary support and swingable about a vertical axis provided at a rear side of said frame and a linkage system for the vertical displacement of the bin, the linkage system comprising first, second and third link-bars; said first link-bar being pivotably mounted at one end to the front end of the frame by a first journal; said second link-bar being pivotably mounted at one end to the front end of the frame by a second journal located below said first journal; said third link-bar being pivotably mounted to the opposite ends of said first and second link-bars by third and fourth journals, respectively; said first, second and third link-bars comprising a spacer means; means for suspending a garbage-bin on said third link-bar; and a handle for pivotting the linkage system about said first and second journals so that said third journal is displaced from a lower position to an elevated position beyond the upper dead-center of the said linkage system defined by a line passing through said first and second journals, for stably supporting said linkage system in said elevated position.

2. The holder as claimed in claim 1 wherein the distance between the said first and second journals is smaller than the distance between the said third and fourth journals.

3. The holder as claimed in claim 1 wherein the distance between the said first and second journals is equal to the distance between the said third and fourth journals, and the distance between the said first and third journals is equal to the distance between the said second and fourth journals.

4. The holder as claimed in claim 1, wherein said frame comprises an upper frame-bar and a lower frame-bar, said first link-bar being pivotably mounted to one face of the upper frame-bar; said second link-bar being pivotably mounted to one face of the lower frame-bar corresponding to said one face of the upper frame-bar; said third link-bar, pivotably mounted to said opposite ends of said first and second link-bars, being formed with a bend such that the portion thereof adjacent to said third journal passes over said one face of said upper frame-bar, and the portion thereof below said fourth journal passes over the face of the lower frame-bar opposite to its said one face of the lower frame-bar.

5. The holder as claimed in claim 1, wherein said first journal comprises spacer provided between said first link-bar and said upper frame-bar, said third link-bar being adapted to engage and to rest against said spacer when said third journal is displaced to said elevated position.

6. The holder as claimed in claim 5 wherein the said first and second journals are symmetrically located with respect to the longitudinal axis of the said frame for mounting the said linkage system thereon in both upright and inverted positions.

7. The holder as claimed in claim 6 as dependent on claim 3 wherein the said first and second journals are non-symmetrically located on said frame, additional journal bores being provided for mounting the said linkage system thereon in both upright and inverted positions.

8. The holder as claimed in claim 1, wherein said bracket means is provided with a horizontally extending arm engageable with a spring-loaded self-opening hinged lid of said bin for closing same when the bin is swung with the frame about said vertical axis.

* * * * *